US006863475B2

(12) United States Patent
DeVaull, III et al.

(10) Patent No.: US 6,863,475 B2
(45) **Date of Patent: *Mar. 8, 2005**

(54) APPARATUS FOR INJECTING FLUIDS

(75) Inventors: George Ellis DeVaull, III, Houston, TX (US); Donald Lee Tharpe, Katy, TX (US)

(73) Assignee: Shell Oil Company, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/426,260

(22) Filed: Apr. 30, 2003

(65) Prior Publication Data

US 2004/0218984 A1 Nov. 4, 2004

(51) Int. Cl.[7] ..... E02D 5/18
(52) U.S. Cl. ..... 405/269; 405/247; 239/271
(58) Field of Search ..... 405/269, 266, 405/267, 247, 248; 239/271, 272, 569, 570, 571, 533.1, 533.15

(56) References Cited

U.S. PATENT DOCUMENTS

| | | | | | |
|---|---|---|---|---|---|
| 1,854,518 | A | | 4/1932 | Little | |
| 2,071,392 | A | | 2/1937 | Crowell | 166/1 |
| 2,248,124 | A | | 7/1941 | Scaramucci | 166/9 |
| RE22,483 | E | | 5/1944 | Burt | 166/1 |
| 2,763,222 | A | | 9/1956 | Herstedt | 111/7.3 |
| 2,853,833 | A | | 9/1958 | Hash | 47/57.5 |
| 3,077,166 | A | | 2/1963 | Delp | 111/7.3 |
| 3,166,034 | A | | 1/1965 | Haroldson et al. | 111/7.3 |
| 3,412,563 | A | | 11/1968 | Sharp, Jr. | 61/46.5 |
| 3,540,837 | A | * | 11/1970 | Pascucci | 43/124 |
| 4,036,435 | A | * | 7/1977 | Pecaro | 239/116 |
| 4,275,842 | A | * | 6/1981 | Purton et al. | 239/446 |
| 4,309,129 | A | | 1/1982 | Takahashi | 405/233 |
| 4,449,856 | A | | 5/1984 | Tokoro et al. | 405/269 |
| 4,453,460 | A | * | 6/1984 | Rabe et al. | 100/73 |
| 4,710,063 | A | | 12/1987 | Faktus et al. | 405/269 |
| 4,725,169 | A | * | 2/1988 | Tazawa et al. | 405/269 |
| 4,753,394 | A | * | 6/1988 | Goodman | 239/542 |
| 4,817,739 | A | | 4/1989 | Jeter | 175/38 |
| 4,859,119 | A | | 8/1989 | Chida et al. | 405/269 |
| 5,697,442 | A | | 12/1997 | Baldridge | 166/286 |
| 5,789,072 | A | * | 8/1998 | Ulrich | 426/281 |
| 5,915,345 | A | * | 6/1999 | Kling et al. | 123/41.35 |
| 6,109,485 | A | | 8/2000 | Amidzich | 222/400.7 |

* cited by examiner

*Primary Examiner*—Heather Shackelford
*Assistant Examiner*—Lisa M. Saldano
(74) *Attorney, Agent, or Firm*—Y. Grace Tsang

(57) ABSTRACT

An apparatus and a process for injecting fluids while prevents backflow are provided. The apparatus comprises a) a hollow core pipe with an open end and a closed end, and containing exit ports in the peripheral wall that are closed when there is no, or low fluid pressure; b) a stationary valve seat, fitted in the pipe; c) an axial sliding plug, disposed to be received in the valve seat where there is no or low fluid pressure thereby closing the exit ports wherein an increase in fluid pressure causes the plug to slide toward the closed end and the opening of the exit ports; and d) a spring held in place between the slidable plug and the closed end, the spring continuously urging the plug in a direction away from the closed end.

18 Claims, 2 Drawing Sheets

FIG. 1
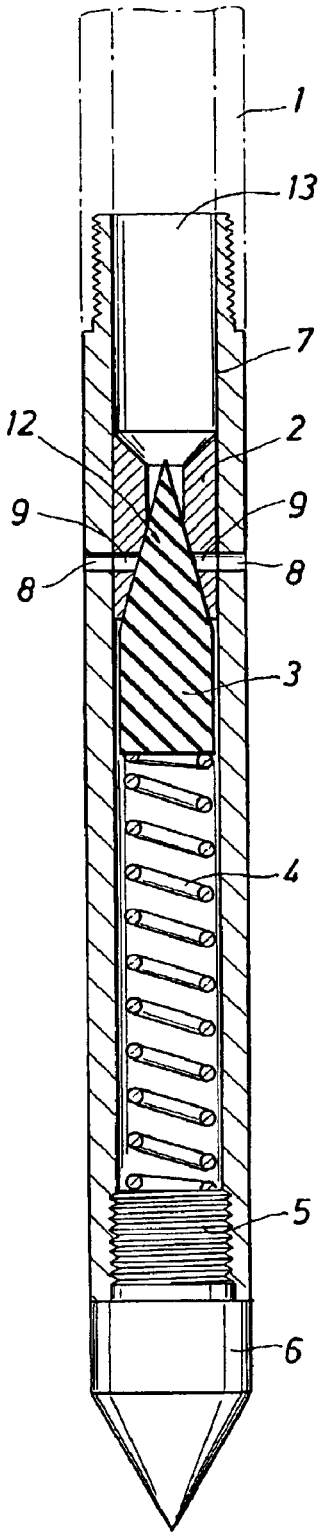
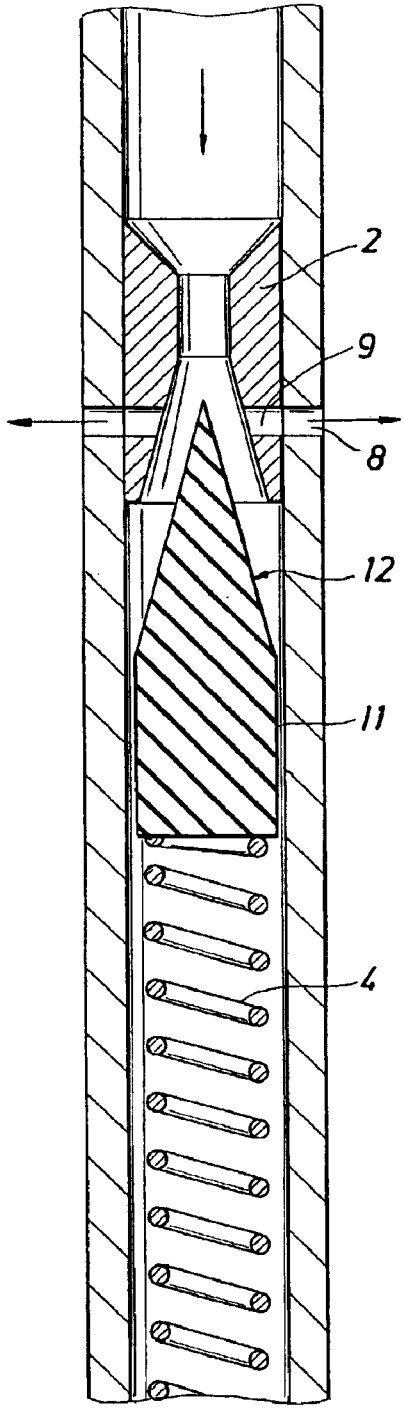
FIG. 2

APPARATUS FOR INJECTING FLUIDS

FIELD OF THE INVENTION

This invention relates to a fluid injection apparatus comprising a valve assembly fitted in a hollow pipe attachable to a hollow drill string. The invention also relates to a method of using such an apparatus.

BACKGROUND OF THE INVENTION

In operations for injecting fluids, such as injecting biomass for remediation, injection has typically been accomplished by using a hollow-core drill rod, such as a 1 to 2 inch diameter drill rod, with a disposable tip. The drill pipe is pushed into the soil using a direct-push system. In an attempt to avoid clogging, the drill pipe is pushed to the desired depth with a disposable tip. The drill pipe is withdrawn upward a few inches with the tip left in place. Then, injection of the biomass is begun, e.g. at a rate of approximately 5–20 gallons/minute, followed by withdrawal of the pipe upwards, e.g. from about 2 ft. to about 10 ft., and then a repeat of the injection. The operation is continued over the vertical zone to be treated.

A common occurrence is that, when the flow of fluids such as biomass is discontinued, in order to pull the drill string upward or add more drill string or change connections, there is a backflow of fluidized soil and water into the injection ports and hollow drill pipe. This backflow clogs the injection ports and the pipe with soil particles. At this point, restarting the injection is impossible without withdrawing the drill string, clearing the soil plug or replacing the pipe, and starting over. In the field, slurry injection operations often suffer significant downtime, restricted operations, and failure due to this backflow of soil. Presently, there does not seem to be any tool available in technology relating to injecting fluids which addresses this problem.

In addition, there is a need for a system that permits the operator to inject every few feet starting, for example at the top of a water table and moving downward, or to move up and down. The current technology requires injection only as the drill pipe is withdrawn. A typical patented direct-push technology for environmental soil sampling is called Geoprobe™ and there are a number of commercially available sampling and injection systems available that use that technology.

U.S. Pat. No. 4,449,856 relates to grout injection. It discloses an injector design with some helpful features, but it contains numerous parts. In addition, it appears that the injecting pipe can be raised a little at a time, but cannot be moved up and down while injecting. U.S. Pat. No. 4,449,856 discloses an apparatus for injection which comprises an inner pipe member and an outer pipe member having one or more injection orifices formed in the sidewall thereof. It further comprises a first passage formed at a peripheral portion of said injection pipe in parallel with an axis of the pipe, a second passage formed in said inner pipe member, a spool valve fitted in said inner pipe member and biased toward the base side of said injection pipe, one or more exit ports which are formed in a sidewall of said inner pipe member and adapted to be closed normally and communicate with said second passage when said spool valve is displaced towards the tip side of said injection pipe, against a biasing force thereof, upon application of a fluid pressure upon said second passage, and an annular mixing chamber formed between said inner and outer pipe members so as to communicate with said one or more injection orifices and said one or more exit ports. This apparatus is designed to permit mixing before injection and contains numerous parts, including a ball type check valve and a spool valve.

U.S. Pat. No. 4,859,119 discloses an apparatus for grout injection which includes a valve moved by a spring. In part it discloses a piston valve vertically movably received in an upper portion of a third channel and having a piston upwardly of said lower communication holes, said piston valve being urged to be normally raised by means of a spring; whereby when said piston valve is raised, said upper communication holes and upper discharge holes are closed by said piston and concurrently said second channel is permitted to communicate with a lower portion of said third channel through said lower communication holes and when said piston valve is lowered, said upper communication holes and upper discharge holes are opened and concurrently said second channel is prevented from communicating with said lower portion of said third channel through said lower communication holes. This grouting rod has multiple moving piston valves. With communication holes always open to the soils/sands/aquifer, this unit becomes susceptible to backflow of soil and clogging. With the piston in the upper or lower position and the opposite communication holes left open without any liquid exiting these holes under pressure then these holes may become a pathway to completely disable this unit because of flowing soil clogging the entire portion that is left exposed. In addition, in the event that a few grains of sand get lodged between the piston and channel may cause the piston to become jammed and cease functioning.

In the art of injecting materials, of any type of slurry, including but not limited to biomass, chemicals, grout, oxidants, slurries for agricultural or remediation purposes, there is a need for a rugged type of injection tool that can be moved up or down while injecting and in addition to having a means for preventing backflow of soil and other materials into the injection pipe while not pumping or making changes to the drill string or pump/hose attachments to the drill string. In addition, due to the nature of such operations, i.e. operating at different soil depths and in different types of soil, it would be extremely desirable if such an apparatus had minimal moving parts that were protected from contact with the soil and permitted easy cleaning. It would also be extremely desirable if the design of the apparatus permitted maintenance of a fluid or slurry column in said drill pipe within the in-soil hollow drill pipe while pump connections and injection pipe extensions were changed at the surface. It would also be preferable to use a permanent tip and not have the expense of constantly replacing disposable tips. In the process of trying to solve these problems, we discovered a design for an apparatus that would accomplish these objectives.

SUMMARY

In accordance to the present invention, it is provided an apparatus, suitable for injecting fluid, having design to prevent backflow of fluid and clogging of the apparatus. The apparatus comprises:

A pipe having:

(a) an open end adapted to receive fluid, (b) at least one exit port(s) in the peripheral wall, (c) a closed end;

A plug coaxially disposed concentrically within said pipe and adapted to slide inside the pipe between the open end and the closed end;

A resilient member held in place between said slidable plug and said closed end, said resilient means continuously urging said plug in a direction away from said close end toward said open end;

wherein (a) when pressure exerted by the resilient member onto the plug toward the direction of the open end exceeds fluid pressure exerted onto the surface of the plug facing the open end toward the direction of the closed end, the plug slides toward said open end to a blocking position and the exit port(s) in the peripheral wall of the pipe is closed by the plug thereby preventing flow of fluid between the inside of the pipe and the outside of the pipe; and (b) when the fluid pressure exerted onto the surface of the plug facing the open end exceeds the pressure exerted by the resilient member toward the open end, the plug disposes to a non-blocking position and said exit port(s) is open to allow fluid to flow from within the pipe to outside the pipe;

Optionally at least one groove, located (a) at the tapered section of said plug or (b) in the seat, having an o-ring inserted therein adapted to improve sealing between the plug and the seat;

Optionally a spring stop within the spring to prevent overstressing the spring or excessive plug travel.

The invention further comprises a method for injecting fluids using afore-mentioned apparatus to prevent backflow of fluids and clogging of the apparatus.

BRIEF DESCRIPTION OF THE DRAWINGS

FIG. 1 is a longitudinal cross section of the injection apparatus according to first embodiment of the present invention, wherein the valve seat having exit ports aligned with the ports in the wall of the hollow pipe and the ports are closed.

FIG. 2 is a fragmentary longitudinal cross-sectional view of the injection apparatus of FIG. 1 shown in a position for the injection of fluid wherein ports are open for injection of fluid.

DETAILED DESCRIPTION OF THE INVENTION

Figure 3:
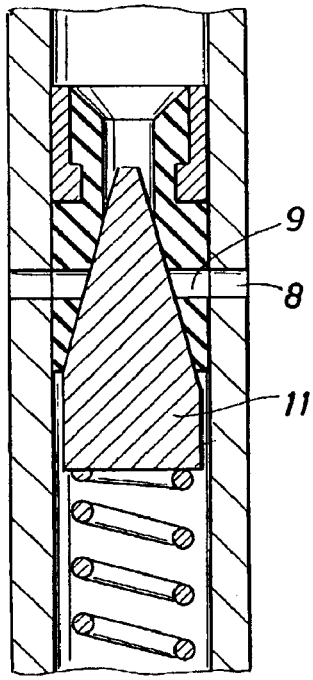
FIG. 3 is a fragmentary longitudinal cross-sectional view of the first embodiment showing a specific arrangement for affixing a valve seat made of a soft material to the hollow pipe.

The present invention relates to an apparatus and a method for injecting a fluid such as a slurry from one location to another. Particularly, it relates to an apparatus and process for injecting fluids to point(s) underground that can inject while moving up or down. It is specifically designed to prevent backflow of soil and fluid into the injection apparatus, as well as avoid clogging of the apparatus by soil and sand. The apparatus is characterized by rugged construction, minimal moving parts, ease of cleaning, a permanent tip, and the capability of maintaining a fluid or slurry column in said drill pipe within the in-soil hollow drill pipe while pump connections and injection pipe extensions are changed at the surface.

The method and apparatus of the present invention can be used to inject any type of fluid. Non-limiting and illustrative examples of suitable applications include injecting chemicals, oxidants, biomass, biosludge, liquids, suspensions, liquid slurries, and grout. It is also suitable for soil and ground remediation and for use in injecting substances for agricultural purposes.

The present injection apparatus is a valve assembly which comprises a hollow pipe closed at one end having exit ports in the wall. Inside of the hollow pipe, there are a plug, a seat, and a spring attached to both the plug and the closed end of the hollow pipe.

Referring to FIG. 1, the apparatus of the first embodiment of the present invention comprises a seat or valve seat 2, plug 3, spring 4, and a tip 6, is within a hollow pipe 7, and is attached to a drill string pipe 1. Fluids to be injected pass through flow ports in the valve seat before exit through ports in the wall of the hollow pipe. There are exit ports drilled in the wall of the hollow pipe, one represented by 8. There are flow ports 9 in the valve seat 2 that is aligned with the exit port(s) 8 in the wall of the hollow pipe. The radial flow ports are either on the tapered section of the valve seat (as shown in FIGS. 1, 2, 3 and 5) or on the section upper from the tapered section. As an illustrative non-limiting example, the tip 6 may be attached to the hollow pipe by a screw 5, which may either be a part of the tip 6 or be attached to the tip 6.

Figure 4:
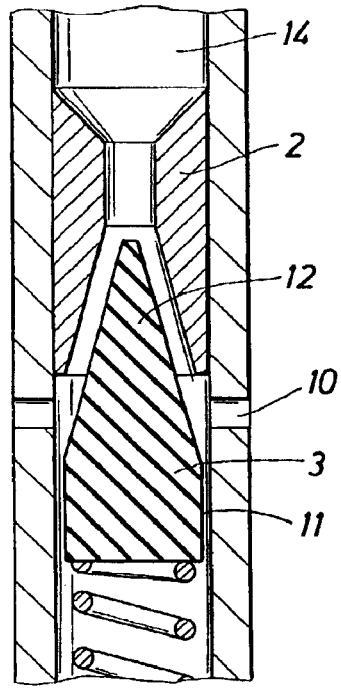
FIG. 4 is a fragmentary longitudinal cross-sectional view of the second embodiment of the present invention, wherein the ports in the wall of the hollow pipe are located below the valve seat.
Figure 5:
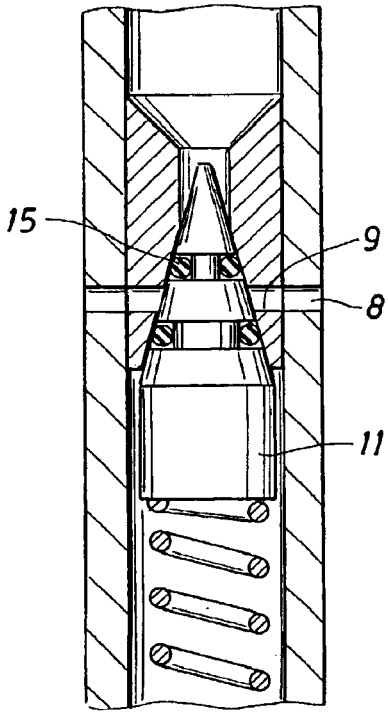
FIG. 5 is a fragmentary longitudinal cross-sectional view of a specific arrangement of the first embodiment of the present invention, wherein the grooves for inserting o-rings are part of the plug.
Figure 6:
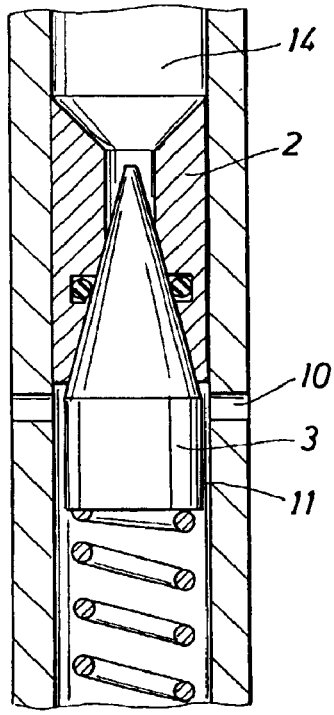
FIG. 6 is a fragmentary longitudinal cross-sectional view of a specific arrangement of the second embodiment of the present invention, wherein grooves for inserting o-rings are part of the valve seat.

Referring to FIG. 4 and FIG. 6, in the second embodiment of the present invention, the apparatus does not have any flow port in the valve seats 2, and there are exit ports 10 through the peripheral wall of the pipe, directly below the valve seat 2 in an area that will be completely covered by the extended cylindrical section 11 of the plug 3.

The valve assembly apparatus of the present invention can be attached to any injection pipe, such as drill pipes or a drill string. The hollow pipe of the present apparatus has an open end 13 adapted to receive fluids, and a closed end 6. The invention is demonstrated by screwing the present inventive injection apparatus via the open end of the hollow pipe on to the end of a drill string 1. The drill string pipe 1 is made of a material suitable to withstand hydraulic hammering forces of emplacement and of sufficient tensile strength to withstand hydraulic hammering forces of withdrawal, typically having a Brinnell hardness of about 100 or more according to ASTM Methods E10, E18, E93, and E140 as relevant, or equivalents thereof, such as high strength steel, e.g. carbon steel, and each is from about 1 to about 20 feet, particularly from about 2 to about 6 feet long.

Depending on the type of fluid and the properties of the soil or sand encountered, the dimensions of the drill pipe can vary, as will be apparent to those skilled in the art. For most situations, a suitable diameter is in the range of from about 0.6 to about 36 centimeters, particularly from about 1.2 to about 13 centimeters, more particularly from about 4 centimeters to about 8 centimeters. In demonstrating the invention, a drill pipe having a diameter of about 1.9 centimeters performed well.

The length of the hollow pipe 7, attachable to a drill string or injection pipe 1, of the present valve assembly can start from 15 centimeters minimum, particularly from about 20 to about 1,250 centimeters and most particularly from about 250 to about 500 centimeter. The diameter of the hollow pipe housing the valve assembly is typically, but not limited to, about the same range as that for the drill pipe, and the materials are typically selected from the same type of materials as that for the drill pipe string as described above. Machining on the high-strength hollow pipe is limited to at least one, particularly from one to ten, more particularly from two to five, holes as exit ports which can be radial in orientation from the center of the hollow pipe. The size of the exit port(s) and flow port(s) is dependent on the various fluids or slurries being injected, as well as volumes and pressures. Illustrative non-limiting examples of suitable diameter for the ports are in the range of from about 1/32 inch to about 1/2 inch, preferably in the range of from about 1/16 inch to 1/4 inch, and most preferably about 1/8 of an inch, plus or minus a fraction. Although a plurality of holes/ports work well and provide better results than tools currently available, as non-limiting examples, there can be from one to about ten, particularly about 3 to 5, or one to two strategically placed holes/ports. One illustrative example relates to a drill pipe attachment valve assembly having three holes of about 1/8 inch each drilled in the wall of the pipe equally spaced at about 120°.

The closed end of the hollow pipe can be permanently closed or sealed. In the alternative, it is closed by having a tip fitted therein by a method selected from (a) friction fit, (b) engaging via threaded portion and screwed on, (c) welding, (d) bolted on, and (e) combinations thereof.

As a particular embodiment of the present invention, there can be a stationary seat, fitted in the hollow pipe, in abutment against the inner wall of the hollow pipe, adapted to seat the slidable plug. As another embodiment of the present invention, the apparatus does not have any valve seat and the plug slides between the open end and the closed end within the hollow pipe.

Both the plug and valve seat can be made of any suitable material. It can be made of a "hard" material such as metal, or a "soft" material softer than the hard material. Suitable metals as hard material include, but not limited to, those having a hardness less than that of the selected pipe material but greater than a Brinnell hardness of about 42, or equivalent, according to ASTM methods E10, E18, E93, and E140, as relevant, selected from those in Group IB, IIIA, IVA or VIII of the Periodic Table, or an alloy thereof, such as aluminum, copper, bronze, and alloys thereof. Preferred metals include metals or metal alloys that are strong enough to not deform under the pressures generated by the pump to depress the selected spring, but that permit machining. When a "soft material" is used, the material must be measurably softer than the hard material, but having a certain range of strength; it must be strong enough not to deform under pressure, but soft enough to embed sand. The pressure it has to withstand could be as high as 10,000 pounds per square inch (psi) or as low as 5 psi, particularly from about 30 to about 600 psi. Suitable soft material include, but are not limited to, rubber, wood, polyolefins, plastics, such as, a high density polyethylene, Teflon®, and the like, preferably having an International Rubber Hardness Degree, according to ASTM D2240, ASTM1415, or ISO 48, consistent with material of hardness in the range of hard to medium-hard natural vulcanized rubber. Additionally, the movable plug is selected of a material with suitable properties to aid the sliding, contacting, and mating of the pipe and valve seat surfaces without spalling, gouging, or chipping of either of the mating or sliding surfaces, or contact freezing of the mating or sliding surfaces.

Where the apparatus comprises a valve seat, the materials fro the valve seat and the plug can be: (1) the plug is made of a hard material which is harder than the hard material of the valve seat, (2) both are made of hard material, but the valve seat is harder that the plug, (3) both are hard material of similar hardness, (4) the valve seat is made of a hard material and the plug is made of a soft material as illustrated in FIG. 4; or (5) the valve seat is made of a soft material and the plug is made of a hard material as illustrated in FIG. 3. As used herein, the hardness of the hard materials is determined in accordance to ASTM Methods E10, E18, E93, and E140 as relevant, or equivalents thereof.

As a particular embodiment of the present invention, there can be at least one sealing device or sealing means 15 fitted in the seat, plug, and/or the wall of the hollow pipe, adapted to improve seating between (a) the plug, (b) the pipe, and/or (c) the seat. The sealing device can be in the form of a groove, fitted with (a) an o-ring, or (b) a mechanical seal such as a piston ring.

As a particular embodiment of the present invention, the present apparatus comprises a valve seat which is frictional fit (interference fitted) into the hollow pipe by any suitable method known to one skilled in the art, such as using a mandrel press and/or heating the outer tube and cooling the valve seat. The seat has flow port(s) which are aligned with the exit port(s) in the peripheral wall of the pipe, wherein when the plug is at a non-blocking open position, the fluid for injection received from the open end of the pipe is permitted to exit the pipe through said flow port(s) in the seat and the exit port(s) in the peripheral wall of the pipe; wherein when the plug is engaged with the seat in said blocking position, it closes both the flow port(s) in the seat and the exit port(s) in the wall to prevent any material from entering into the pipe from outside of the pipe through said port(s).

In another particular embodiment of the present invention as demonstrated in FIGS. 4 and 6, the exit port(s) 10 in the wall of the hollow pipe is located below the valve seat. When the plug is at a blocking position, the exit port(s) 10 in the peripheral wall of said pipe is blocked by the plug, and the plug closes the passage 14 to the open end, thereby preventing any more fluid from entry to the passage 14. Where the plug is tapered, the exit ports are blocked by the straight section 11 or large-diameter portion of the plug, and not in contact with the tapered portion 12 of the plug.

The valve is completely protected within the hollow pipe; there is no exposure to soil or rocks during use. The shape of the valve seat can vary. As shown in the FIGS. 1–6, the valve seat is tapered such that the diameter or the center passage increases toward the closed end or lower end of the drill pipe. It can also be cylindrical in shape. In any case, the valve seat is angled exactly to fit the portion of the plug facing the open end.

The shape of the plug can contribute to the efficiency of the design. Illustrative and non-limiting examples of the shape include (a) cylindrical and uniform in diameter throughout the entire length of the plug, (b) cylindrical but tapered and extending toward the valve seat, and others.

Where the plug is tapered, the end of said plug facing the open end is tapered and merges into a large-diameter portion which can come into slidable contact with the peripheral wall of said pipe; and said seat is concave and adapted to seat the tapered plug at the tapered end, and the plug and seat can have surfaces mating to each other with sufficient surface contact to prevent fluid flowing therethrough; the plug has a larger surface area, for example, extending up through the valve seat in a conical shape so that the fluid pressure can be exerted on the increased surface area of the plug. The operator of the injection system can effectively use less pump head pressure to actuate the valve to obtain the same result. In this configuration, when the pump pressure is decreased the full force of the spring is used to reseat the piston valve into the valve seat before soils can enter the drill string.

The outer diameter of the largest diameter section of the plug is clearance or friction fit to the inner diameter of the hollow pipe. By clearance or friction fit, it means that the difference between the inner diameter of the hollow pipe and that of the largest diameter portion of the plug is nominal or from about 0.001 to about 0.02 inches, particularly from about 0.002 to about 0.1 inches.

A resilient member, such as a mechanical or pneumatic spring, is held in place between the slidable plug and the closed end of said pipe. The resilient member (means) continuously urges the plug in a direction away from the closed end, wherein said resilient member is designed to push the plug to a position blocking the exit port(s). When pressure exerted by the resilient member onto the plug toward the direction of the open end exceeds fluid pressure exerted onto the surface of the plug facing the open end toward the direction of the closed end, the plug slides toward said open end to a blocking position and the exit port(s) in the peripheral wall of the pipe is closed by the plug thereby preventing flow of fluids between the inside of the pipe and the outside of the pipe, and the plug also closes the passage to the open end thereby preventing fluids to be injected from entry into the injection apparatus; and when the fluid pressure exerted onto the surface of the plug facing the open end exceeds the pressure exerted by the resilient member toward the open end, the plug disposes to a non-blocking position and said exit port(s) is open to allow fluid to flow from within the pipe to outside the pipe.

Where the apparatus does not have a stationary seat, the spring is designed to push the plug to rest at a position blocking the exit port(s) when the actual differential pressure P' is less than "design differential pressure value 'P'; and at a P' exceeding P, excess fluid pressure forcing the axial plug sliding toward the closed end. A "differential fluid pressure" means the pressure difference from the top of the pipe (such as point 13 in FIG. 1 if FIG. 1 did not have a valve seat) minus that at the exit port(s) (such as point 8 in FIG. 1 if FIG. 1 did not have a valve seat). The "design differential pressure value 'P' is the pressure at which the spring is designed to rest at a position blocking the exit port(s), and it is selected from a pressure ranging from about 2 to about 5,000 psi, particularly from about 5 to about 600 psi and more particularly from about 10 to about 200 pounds per square inch (psi). Where there is a stationary seat, the spring is designed to seat the axial plug against the valve seat at a selected designed differential fluid pressure level, P, of from about 2 to about 5,000 psi, particularly from about 5 to about 600 psi and more particularly from about 10 to about 200 pound per square inch (psi). The actual differential pressure P' is the pressure difference from that above the valve seat minus that at the exit port(s), and at a P' being less than P, excess spring force is taken by the mating axial plug and valve seat surfaces; excess spring force being sufficient to ensure bubble-tight sealing between the mating axial plug and valve seat surfaces, this being identified as a closed "blocking" position; at a P' being greater than P, excess fluid pressure forcing the axial plug toward the closed end, thusly separating the mating axial plug and valve seat surfaces, continuously urging said axial plug toward the closed end within the pipe, the sliding plug progressively exposing the exit ports/holes in the pipe wall, allowing fluid flow from within the pipe to exit through the pipe exit port(s)/hole(s), this being identified as an open flow non-blocking position.

At differential pressures greatly exceeding the design value, P, fluids flow continuing to exit the fully exposed exit ports in an open flow non-blocking position, and the sliding plug being continuously urged toward the closed end against increasing spring force, to a final axial plug position at which the spring is at a fully compressed position either fixed by an optional internal stop mounted within the closed end of the pipe, or for a helical mechanical spring, with the coils of the spring fully compressed against each other, further excess pressure thusly being unable to exceed the design force of the spring and eliminating irreversible damage to the spring due to over-tensioning. From an open flow position, with actual differential pressures exceeding the design value P, and fluid exiting the pipe exit port(s)/orifice (s), a decrease in actual differential pressure allows the spring force to urge said plug to move in a direction toward the open end, the mating sliding surfaces of the sliding plug and internal pipe surface wipes possible fouling, matter, and debris from the exit port(s) as said plug continuously slides toward the open end toward a closed position. The composition and required strength coefficient of the spring depend upon the amount of force required to compress, the type and volume of slurry to be injected and the pressure to be exerted, and the soil and water conditions.

In addition, in most uses the reduction in pressure is not immediate; it takes, for example, from about less than 2 to about 9 or 10 seconds for the injected fluid to dissipate into the surrounding soils and the pressure of the injected fluid in soil to decrease, depending primarily on the permeability and capacity of the surrounding soils, as well as other factors and the spring has to be able to react to the constantly changing pressure and close the valve.

Suitable materials for the spring include, but not be limited to, spring steel, metal alloys or steel containing percentages of various metals in amounts that give the spring the required strength for the objective and conditions to be encountered. A stiffer spring is suitable where pressure needs to be maintained because of surging sands in an aquifer or fluidized soils because of injections. And a lighter spring is suitable where it is desirable to inject fluids above or below an aquifer that does not have surging sands and is made of a soil containing mostly clays.

A spring stop within the spring may be added to prevent over pressurizing the spring or excessive plug travel.

In assembly, the closed end of the pipe is initially kept open, and the plug is inserted into from the pipe from this end, backed by a resilient member, such as mechanical or pneumatic spring, followed by closing this end, such as having a tip screwed in.

In operation, in an initial position, before pressure is asserted by fluids to be injected, the plug is usually resting at a blocking position and the exit ports are closed. The injection of fluids pushes the plug toward the closed end, and where there is a valve seat the fluid pressure unseats the plug and fluids flow out of the exit ports/holes in the peripheral wall of the pipe. When injection pressure is relieved, the spring pushes the plug toward the open end (and where there is a valve seat, it reseats the valve) in a position to close the exit port(s) to prevent backflow. Furthermore, the plug is adapted to close the passage to the open end thereby preventing any fluid, to be injected, from entry into the injection apparatus.

For underground injection, the present injection apparatus is often connected to a drill string pipes, and hammered to the desired depth, for example by a Geoprobe direct-push rig. Fluids to be injected can be pumped from a storage tank at a rate of from about 5 gallons per minute to about 200 gallons per minute, particularly from about 10 gallons per minute to about 50 gallons per minute, at a pressure from about 5 psi to about 10,000 psi, particularly from about 30 psi to about 600 psi into the upper end of the drill sting pipe. The injection pressure pushes the plug downward, and fluids such as biomass flows out of the exit port(s) in the pipe. When the injection pressure is relieved, the plug slides back to the blocking position or the plug reseats, thus preventing backflow into the injection ports and drill pipe thereby avoiding clogging the exit ports and the pipe with soil particles. Furthermore, the plug is adapted to close the passage to the open upper end, thereby preventing any fluid, to be injected, from entry to the injection apparatus. Subsequently, the pipe is often hammered to the next deeper injection area or withdrawn upward, and the process is repeated. This makes it possible to continue to inject while moving up or down.

The invention provides a number of advantages over anything currently available in the art:

1. A fluid column can be maintained in the entire injection pipe and the present injection apparatus while in soil, even at a significant depth, while pump connections and injection pipe extensions are changed at the surface.

2. The design prevents backflow of soil and sand which clogs all sizes of drill pipes when they are exposed to flowing soils or an attempt is made to go to greater depths.

3. The valve assembly is closed at the lower end, optionally uses a permanent tip, and saves the expense of continually replacing disposable tips.

4. Since the lower end of the valve assembly is closed, optionally by a tip 6 which stays in place, the apparatus can be moved up and down to various depths in the soil without interruption of the injection process.

5. The apparatus can be operated in either continuous injection flow or intermittent injection flow, depending on selection of spring rate constant, injected fluid properties, soil type, and value geometry.

6. The apparatus can be used with a range of equipment such as (a) direct-push technology (Geoprobe™) that can be transported on a vehicle as small as a pick up truck or garden tractor to (b) large diameter hollow stem auger drilling equipment with large motive force generators, such as in on-shore or off-shore drilling operations for injecting fluids, grouts, cements, etc.

7. The apparatus contains only two moving parts, the plug 3 and the spring 4, and is easily disassembled, cleaned and reassembled.

8. The valve/plug and spring are isolated from direct contact with soils outside the pipe.

The apparatus/tool can be operated effectively in surging sands and flowing soils. This has not been possible previously with tools available in the art that allow the sands to shoot to the surface through hollow pipes, or completely clog all fluid passageways.

As one specific embodiment of the present invention, a process for remediating MTBE and/or TBA in the aquifer (groundwater, saturated zone, water-bearing zone, sub-soil) is provided using the present injection apparatus for injecting to the treatment zone a mixed bacterial culture or pure bacterial culture described in U.S. Pat. No. 5,750,364, U.S. Pat. No. 5,811,010, and U.S. Pat. No. 6,238,906, assigned to Shell Oil Company, the descriptions of these patents are herein incorporated by reference.

The invention will be illustrated by the following illustrative embodiments which are provided for illustration purpose only and are not intended to limit the scope of the instant invention.

Illustrative Embodiment

An injection apparatus was designed and constructed as illustrated in FIG. 4. The hollow pipe was made of high carbon steel, the same as the attached drill pipe. It was approximately 14 inches in length, 1.25 inches outside diameter, 0.625 inches inside diameter, with a internal female threaded section at the lower end and a external male threaded section at the upper end. A cylindrical brass valve seat was constructed, of nominal 0.625 inches outside diameter, with a 0.375 inch diameter center hole through the cylindrical axis, and, at the lower end, an axially concentric concave conical tapered seat, 1 inch in length along the axis, 0.375 inches in diameter at the inner narrow end and 0.5 inch diameter at the outside bottom end of the cylinder. The valve seat was friction fitted into the drill pipe with a mandrel press, to a location with the top of the seat 2 inches from the upper pipe end. Three radial 0.125 in. holes were drilled through the pipe wall, equally spaced at 120° around the circumference, 0.375 inches below the lower end of the machined brass valve seat. A cylindrical tapered plug constructed of ultra high molecular weight polyethylene, was machined in a shape in the tapered section to mate with the valve seat, and had a final total length of 2-in. A selection of helical steel springs of 0.5 inch outside diameter and uncompressed lengths of 4 to 8 inches, with rated collapse force in the range of 25 to 600 pounds, were used in testing the operation. This range of springs provided a design pressure level, P, for valve opening, in the range of approximately 6 PSI to 800 PSI.

In assembly, the tapered plug was inserted into the lower end of the pipe, backed by a helical coil spring, and a threaded carbon steel drive tip was screwed into the lower end of the assembly, which held the plug and spring in place.

In operation, the valve assembly apparatus was screwed onto the lower end of a Geoprobe (TM) drill string. The drill string consisted of 4 ft sections of 1.25-inch outside diameter, 0.625 inch inside diameter high carbon steel threaded at each end with mating female and male pipe threads. A Geoprobe direct-push rig was used to advance the pipe to the desired initial depth of 16-ft.

The ranges and limitations provided in the instant specification and claims are those which are believed to particularly point out and distinctly claim the instant invention. It is, however, understood that other ranges and limitations that perform substantially the same function in substantially the same manner to obtain the same or substantially the same result are intended to be within the scope of the instant invention as defined by the instant specification and claims.

We claim:

1. An apparatus for injecting fluid underground, which apparatus comprises:

a pipe with a diameter of from about 0.6 cm to about 36 cm having (a) from one to ten exit ports in the peripheral wall, each port being from about 3 mm to about 5 cm in effective diameter, (b) an open upper end of the pipe adapted to receive fluid to be injected, and (c) a closed bottom end;

an axial plug coaxially disposed concentrically inside said pipe and adapted to slide up and down inside the pipe, wherein said plug is tapered at the upper end of the plug and having an upper surface adapted to be acted on by the pressure of the fluid fed into said pipe;

a stationary seat, disposed inside the upper end of the pipe in abutment against the inner wall of said pipe, adapted to seat said slidable plug when the plug is disposed at a position blocking said port(s); and said seat is concave and adapted to seat the tapered plug at the tapered end, and the plug and seat have surfaces mating to each other with sufficient surface contact to prevent fluid flowing therethrough; and a mechanical or pneumatic spring held in place between said slidable plug and said closed bottom end of said pipe, said spring is adapted to continuously urge said plug in an upward direction away from said closed bottom end, wherein said spring is designed to seat the axial plug against the seat thereby closing said exit port(s) when the actual differential pressure (P') is equal or less than a design differential pressure value (P), wherein P is a pressure ranging from about 2 to about 5,000 pounds per square inch;

wherein, at an actual differential pressure (P') greater than design differential pressure value (P), excess fluid pressure forcing the axial plug downward, thus separating the mating axial plug and stationary seat surfaces, continuously urging said axial plug downward within the pipe, the sliding plug progressively opening the exit ports in the pipe wall to a non-blocking position, allowing fluid flow from within the pipe to exit through the exit ports in the pipe.

2. The apparatus as claimed in claim 1, wherein the apparatus further comprises at least one groove, located (a) at the tapered section of said plug or (b) in the seat, having an o-ring inserted therein adapted to improve sealing between the plug and the seat; and a spring stop within the spring to prevent overstressing the spring or excessive plug travel.

3. An apparatus, suitable for injecting fluid, which comprises:

a pipe having:

(a) an open end of the pipe adapted to receive fluid, (b) at least one exit port(s) in the peripheral wall, (c) a closed end;

a plug coaxially disposed concentrically within said pipe and adapted to slide inside the pipe between the open end of the pipe and the closed end, and a resilient member held in place between said slidable plug and said closed end, said resilient member continuously urging said plug in a direction away from said close end toward said open end of the pipe;

wherein (a) when pressure exerted by the resilient member onto the plug toward the direction of the open end of the pipe exceeds fluid pressure exerted onto the surface of the plug facing the open end toward the direction of the closed end, the plug slides toward said open end to a blocking position and the exit port(s) in the peripheral wall of the pipe is closed by the plug thereby preventing flow of fluid between the inside of the pipe and the outside of the pipe; and (b) when the fluid pressure exerted onto the surface of the plug facing the open end exceeds the pressure exerted by the resilient member toward the open end, the plug disposes to a non-blocking position and said exit port(s) is open to allow fluid to flow from within the pipe to outside the pipe.

4. The apparatus as described in claim 3, wherein said pipe having fitted therein a stationary seat in abutment against the inner wall of said pipe, disposed to seat said slidable plug when the plug is positioned at a blocking position.

5. The apparatus as described in claim 4, wherein said seat has flow port(s) which are aligned with the exit port(s) in the wall of the pipe, wherein when the plug is at a non-blocking open position, fluid received from said open end of the pipe is permitted to exit the pipe through said flow port(s) in said seat and said exit port(s) in the peripheral wall of the pipe.

6. The apparatus as claimed in claim 4, wherein the end of said plug facing the open end is tapered and merges into a large-diameter portion which can come into slidable contact with the peripheral wall of said pipe; and said seat is conical and adapted to seat the tapered plug at the tapered end, and the plug and seat have surfaces mating to each other with sufficient surface contact to prevent fluid flowing therethrough.

7. The apparatus as claimed in claim 6, wherein said seat having flow port(s) which are aligned with said exit port(s) in the peripheral wall of the pipe to allow fluid to exit the pipe when said plug is disengaged from said seat in a non-blocking position; wherein when the plug is engaged with the seat in said blocking position, it closes said flow port(s) in the seat and said exit ports in the wall to prevent any materials from entering into the pipe from outside of the pipe through said port(s).

8. The apparatus as claimed in claimed in claim 6, wherein the exit port(s) in the wall of the pipe is located below the valve seat; wherein when said plug is at blocking position, said exit port(s) in the peripheral wall of said pipe is blocked by the large-diameter portion of the plug and not in contact with the tapered portion of the plug.

9. The apparatus as claimed in claim 4, wherein there is at least one sealing device fitted in the wall of the pipe, seat and/or plug, adapted to improve sealing between (a) the plug, (b) the pipe and/or (c) seat.

10. The apparatus as claimed in claim 4, wherein there is at least one groove fitted with (a) o-ring or (b) a mechanical seal.

11. The apparatus as claimed in claim 4, wherein at least one of (a) the plug and (b) seat is made of a hard material and the other is made of a hard material or a soft material.

12. The apparatus as claimed in claim 11, wherein said hard material is selected from the group consisting of (a) a metal or alloy thereof of Group IB, IIIA, IVA, steel, bronze, brass, and aluminum; and said softer material is selected from the group consisting of rubber, polyolefins, plastic, Teflon® and wood.

13. The apparatus as claimed in claim 3, wherein said closed end is closed by having a tip fitted therein, wherein said tip is fitted into the end of said pipe by a method selected from (a) friction fit, (b) engaging via threaded screw, (c) welding, (d) bolted on, and (e) combinations thereof.

14. The apparatus as claimed in claim 3 characterized in that it permits the maintenance of a fluid or slurry column in said pipe while a pump connection or pipe extensions is changed at the surface.

15. The apparatus as described in claim 3, wherein the resilient member is a spring and the apparatus further comprises a spring stop within the spring to prevent overstressing the spring or excessive plug travel.

16. A method for injecting fluid, which method comprises the steps of:

delivering a fluid using an apparatus comprising:

a pipe having:

(a) an open end adapted to receive fluid, (b) at least one exit port(s) in the peripheral wall, (c) a closed end;

a plug coaxially disposed concentrically within said pipe and adapted to slide inside the pipe between the open end and the closed end, and a resilient member held in place between said slidable plug and said closed end, said resilient member continuously urging said plug in a direction away from said close end toward said open end;

wherein (a) when pressure exerted by the resilient member onto the plug toward the direction of the open end of the pipe exceeds fluid pressure exerted onto the surface of the plug facing the open end toward the direction of the closed end, the plug slides toward said open end to a blocking position and the exit port(s) in the peripheral wall of the pipe is closed by the plug thereby preventing flow of fluid between the inside of the pipe and the outside of the pipe; and (b) when the fluid pressure exerted onto the surface of the plug facing the open end of the pipe exceeds the pressure exerted by the resilient member toward the open end of the pipe, the plug disposes to a non-blocking position and said exit port(s) is open to allow fluid to flow from within the pipe to outside the pipe.

17. The method for injecting fluid as described in claim 16, wherein said apparatus comprising:

a pipe with a diameter of from about to about 0.6 cm to about 36 cm having (a) from one to ten exit ports in the peripheral wall, each port being from about 3 mm to about 5 cm in effective diameter, (b) an open upper end of the pipe adapted to receive fluid to be injected, and (c) a closed bottom end;

an axial plug coaxially disposed concentrically inside said pipe and adapted to slide up and down inside the pipe, wherein said plug is tapered at the upper end of the plug and having an upper surface adapted to be acted on by the pressure of the fluid fed into said pipe;

a stationary seat, disposed inside the upper end of the pipe in abutment against the inner wall of said pipe, adapted to seat said slidable plug when the plug is disposed at a position blocking said port(s); and said seat is concave and adapted to seat the tapered plug at the tapered end, and the plug and seat have surfaces mating to each other with sufficient surface contact to prevent fluid flowing therethrough; and a mechanical or pneumatic spring held in place between said slidable plug and said closed bottom end of said pipe, said spring is adapted to continuously urge said plug in an upward direction away from said closed bottom end, wherein said spring is designed to seat the axial plug against the seat thereby closing said exit port(s) when the actual differential pressure (P') is equal or less than a design differential pressure value (P), wherein the design differential pressure (P) is a pressure ranging from about 2 to about 5,000 pounds per square inch;

wherein, at an actual differential pressure (P') greater than the design differential pressure (P), excess fluid pressure forcing the axial plug downward, thus separating the mating axial plug and stationary seat surfaces, continuously urging said axial plug downward within the pipe, the sliding plug progressively opening the exit ports in the pipe wall to a non-blocking position, allowing fluid flow from within the pipe to exit through the exit ports in the pipe.

18. The method as claimed in claim 16, wherein the apparatus further comprises at least one groove, located (a) at the tapered section of said plug or (b) in the seat, having an o-ring inserted therein adapted to improve sealing between the plug and the seat; and a spring stop within the spring to prevent overstressing the spring or excessive plug travel.

* * * * *